US005634249A

United States Patent [19]

Ballarati

[11] Patent Number: 5,634,249

[45] Date of Patent: Jun. 3, 1997

[54] PROCESS FOR THE PRODUCTION OF MULTIFILAMENT YARN DRAWN IN THE INTERLACING STAGE, FROM PARTIALLY ORIENTED THERMOPLASTIC YARNS

[76] Inventor: Vito Ballarati, Via Verdi 4, 40024 Imola (Prov. of Bologna), Italy

[21] Appl. No.: 357,949

[22] Filed: Dec. 16, 1994

[30] Foreign Application Priority Data

Sep. 6, 1994 [IT] Italy ..... MI94A1827

[51] Int. Cl.[6] ..... D02J 1/22

[52] U.S. Cl. ..... 28/246; 28/240; 28/271

[58] Field of Search ..... 28/220, 240, 246, 28/271, 258

[56] References Cited

U.S. PATENT DOCUMENTS

| | | | |
|---|---|---|---|
| 4,035,883 | 7/1977 | Bond | 28/246 |
| 4,217,323 | 8/1980 | Foster et al. | 28/271 |
| 4,318,210 | 3/1982 | Foster et al. | 28/246 |
| 4,644,622 | 2/1987 | Bauer et al. | 28/271 |
| 4,894,894 | 1/1990 | Coons, III et al. . | |
| 4,965,916 | 10/1990 | Artune et al. | 28/271 |

FOREIGN PATENT DOCUMENTS

| | | |
|---|---|---|
| 0119044 | 9/1984 | European Pat. Off. . |
| 0152919 | 8/1985 | European Pat. Off. . |

*Primary Examiner*—C. D. Crowder
*Assistant Examiner*—Larry D. Worrell, Jr.
*Attorney, Agent, or Firm*—Kenyon & Kenyon

[57] ABSTRACT

A process and apparatus for simultaneously drawing and interlacing partially oriented thermoplastic yarns. The process is carried out in a single apparatus by maintaining the yarn under drawing tension and simultaneously contacting the tensioned yarn with a gaseous fluid at an angle, temperature and pressure such that the yarn is simultaneously drawn and interlaced at the point it is being drawn.

11 Claims, 1 Drawing Sheet

PROCESS FOR THE PRODUCTION OF MULTIFILAMENT YARN DRAWN IN THE INTERLACING STAGE, FROM PARTIALLY ORIENTED THERMOPLASTIC YARNS

Process for the production of multifilament yarn drawn in the interlacing stage, from partially oriented thermoplastic yarns.

FIELD OF THE INVENTION

The present invention relates to a process for the preparation of multifilament yarns, which are wound either singly on cone or in the form of parallel yarn bundle on warp beam, from partially oriented thermoplastic yarns, wherein interlacing and drawing are carried out simultaneously.

The yarns obtained according to the process of the present invention may be used both as warp yarns and as weft yarns for the manufacture of textiles.

PRIOR ART

The processes for the production of drawn and interlaced thermoplastic multifilament yarns known so far are substantially the following:

a) yarns are drawn during spinning with hot or cold buckets: the yarn tension is controlled only after drawing on cold buckets and reduced to values compatible with interlacing, which is carried out by the known fluid-jet interlacing apparatus.

The yarn speed, depending on the spinning process, is necessarily very high; consequently, a scarce and irregular interlacing is obtained (few knots/meter).

b) The starting material consists of partially oriented yarns (LOY, MOY, POY, HOY type) which are drawn on drawing-twisting or drawing-winding machines. In this process, partially oriented yarns are drawn by passage between two rolls revolving at a different surface speed. Some thermoplastic yarns, such as nylon 66, polyester, polypropylene, may be drawn only if suitably heated.

After drawing, yarns under low tension are interlaced and then wound on bobbins or cops by a traditional interlacing machine.

c) Partially oriented yarns in the form of parallel yarn bundles are caused to pass on a hot plate or through a liquid bath to be heated as required for drawing. After drawing, the yarns under a low tension are singly interlaced; then they are either wound on beam or fed to a sizing bath.

d) The starting material is a completely drawn yarn, wound on bobbins, cops or warp beams: interlacing is carried out on single yarns, which are then wound on the aforesaid devices.

PROCESS ACCORDING TO THE INVENTION

The starting material consists of partially oriented multifilament thermoplastic yarn (POY) from spinning and wound on bobbin.

A bundle of yarns is unwound from a set of bobbins arranged on a creel. The yarns are parallelled and spaced, as predetermined, by a reed; they are then sent to inlet rolls revolving at constant surface speed, wherefrom, always running parallelly, they are fed to single chambers (one for each yarn) where a jet of steam or of another fluid at an appropriate temperature, is injected through a side nozzle positioned in such a way as to provide a jet perpendicular to the yarn direction. On leaving said chambers, yarns are pulled by outlet rolls revolving at a higher surface speed than the inlet ones, whereby they are tensioned as required for drawing.

The combined action of the set of steam (or of another fluid at a suitable temperature) and of the tension imparted by the outlet rolls causes simultaneous yarn drawing and interlacing in the aforesaid chambers. The yarns obtained, which are completely drawn and interlaced, are sent to single yarn cop winders or are parallel if wound, one close to the other, on warp beams. In the former case, the product obtained is wound on bobbins or cops for use as single yarn, in the latter the product is directly used for warp in weaving.

Figure 1:
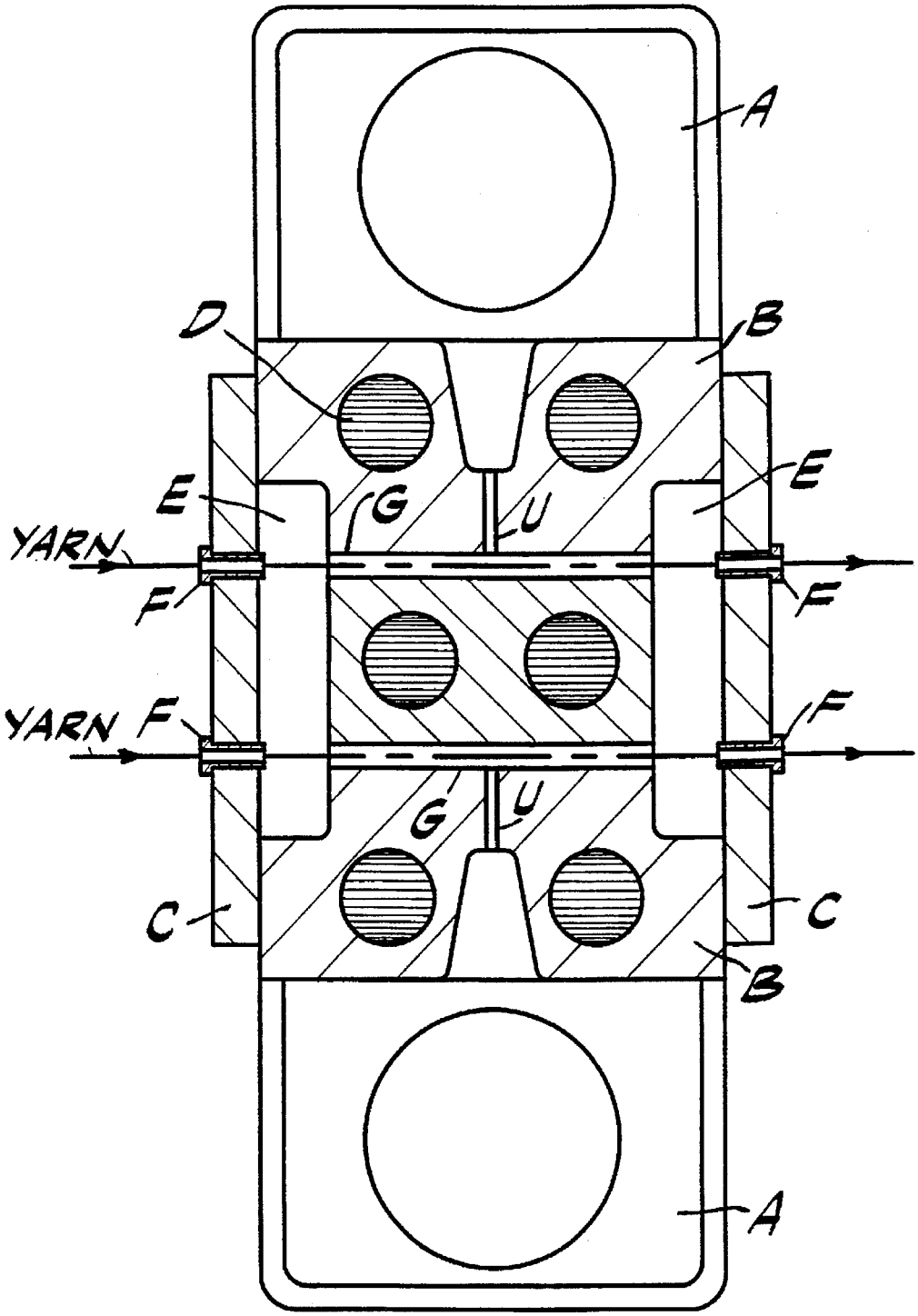
FIG. 1 shows the apparatus allowing the implementation of the claimed process. The yarn inlet and outlet nozzles are indicated by (F); by means of said nozzles, the yarn is also maintained in a central position of the drawing and interlacing chamber; therefore, a good interlacing uniformity is obtained.

Tubular-shaped drawing-interlacing chamber (G) has circular section with width depending on the type of treated yarn (count, number of filaments, etc.). A jet of steam (or of another fluid) is admitted into said chamber in a transverse direction to the yarn direction through nozzle (U). The nozzle diameter depends on the type of treated yarn (count, etc.). Steam (or another fluid) from the drawing-interlacing chamber is discharged through chambers (E).

The apparatus includes heating elements (D) preventing (partial) steam condensation and steam chamber (A), where the pressure of steam to be fed to the nozzle is controlled and set to the optimal value for the type of yarn (count, etc.) and for the degree of interlacing desired.

(B) is a plate with built-in steam nozzle and (C) is a plate bearing yarn-guide nozzles.

DETAILED DESCRIPTION OF THE EMBODIMENT OF THE INVENTION

A major and original feature of the process according to the present invention is the simultaneous interlacing and drawing of a yarn under drawing tension. This finding is surprising because all interlacing processes known so far operate on yarns under no tension or under a low yarn winding tension. The process according to the present invention envisages the interlacing of only partially oriented yarns at a temperature and under a tension suitable for drawing. Therefore, the operating conditions are substantially different from those of the processes known.

The yarn subjected to drawing exhibits a transition zone denominated "drawing neck". Upstream of the drawing neck, the yarn is only partially oriented and, therefore, can be easily deformed; downstream of the drawing neck, the yarn is completely drawn and, therefore, can be hardly deformed.

In the drawing neck zone, the feed may easily undergo permanent deformation because of its low degree of molecular orientation an because of the action of turbulent-flow heated fluid.

Therefore, the mechanical interlacing action of the jet of steam (or of another fluid at a suitable temperature) on the yarn is exerted at particular conditions, substantially different from the interlacing conditions of the known processes: in fact, the yarn is highly tensioned (drawing tension), is heated to a high temperature which is suited for drawing and, therefore, is thermoplastic. It follows that some filaments undergo permanent deformation. Consequently, interlacing is both very effective and regular, although it is carried out at the same time as drawing and, therefore, on a yarn under high tension.

In the practice, the fluid used in simultaneous drawing and interlacing operation is at 75° C. to 200° C., depending on the material to be treating and on the operating conditions (yarn speed, etc.).

The drawing and interlacing process according to the present invention reduces the possible occurrence of broken ends.

The yarns obtained show a high interlacing degree with uniform and stable interlacings (number of knots), even when operating at high speed.

The claimed process allows savings in the drawing and interlacing operations.

It is a further advantage of the present invention that the machines for drawn and interlaced yarns manufacture are greatly simplified, which results in a considerable economic saving.

It is a further benefit of the present invention that the yarns may be wound on weaving beams and then used in weaving processes without sizing.

The yarns produced according to the present invention exhibit a pronounced residual shrinkage. Therefore, said yarns may be used to manufacture special fabrics, such as crepes of untwisted yarns, fabrics of bulked yarns, wrinkled fabrics, etc.

Should fabrics from unshrinked yarn have to be obtained, the yarn will be stabilized by heat setting.

The following examples illustrate the claimed invention. These examples are illustrative only; in no event are they to be regarded as limiting the scope of the invention.

EXAMPLE 1

No. 4 bobbins of partially oriented polyester yarn (POY) having the characteristics indicated below, were placed on a creel of a drawing-twisting frame.

| | |
|---|---|
| Count | 125 dtex |
| No. of filaments | 68 |
| Filament section | circular |
| Breaking strength | 340 g |
| Elongation at break | 143% |
| Calculated stretch ratio | 1.602 |
| Final count | 78 dtex (62.4% of the original) |
| Uster CV | 1.3 |

Yarns were unwound and drawn between a cold roll and a cold bucket. During drawing, each yarn passes through a ceramic tubular interlacing device. Each ceramic tube was provided with a 1.2 mm dia. hole, for the injection of steam at 4 Bar.

The machine operating speed was of 800 m/min. Once the yarns had been drawn and interlaced, they were wound on No. 4 cops revolving at 8000 r.p.m.

The characteristics of drawn and interlaced yarns are averagely as follows:

| | | |
|---|---|---|
| Count | 78 dtex | 78 (*) |
| Breaking strength | 313 g | 313 g |
| Elongation at break | 29% | 32% |
| Shrinkage in boiling water | 20% | 5% |

-continued

| | | |
|---|---|---|
| Uster CV | 1.3 | 1.3 |
| Knot strength | excellent | weak |
| No. of knots/m | 35 | 20 |

(*) according to the known technique, process b. No. 4 cops, each weighing 3 kg, were produced. Cops did not show broken ends on the surface.

EXAMPLE 2

No. 160 bobbins of partially oriented polyester yarn (POY) having the characteristics indicated below, were placed on a creel of a drawing-warping frame.

| | |
|---|---|
| Count | 125 dtex |
| No. of filaments | 68 |
| Filament section | circular |
| Breaking strength | 304 g |
| Elongation at break | 143% |
| Calculated stretch ratio | 1.602 |
| Final count | 78 dtex |
| Uster CV | 1.3 |

Yarns were warped under a tension of 8 g and spaced evenly by a reed. Yarns were anchored to a revolving roll (surface speed 389 m/min).

The yarns From the roll were fed to a two-level 1380-yarn interlacing machine (690 yarns/level).

The interlacing device, provided with a 1.2 mm dia. hole, was fed with steam at 4 Bar.

The yarns leaving the interlacing device, were pulled by a revolving roll (surface speed 584 m/min). During said operation, yarns were drawn and at the same time interlaced. On leaving the drawing roll, yarns were collected on No. 3 knitting machine beams.

The characteristics of said yarns are averagely as follows:

| | | |
|---|---|---|
| Count | 80 dtex | 80 (*) |
| Breaking strength | 300 g | 300 g |
| Elongation at break | 32% | 32% |
| Shrinkage in boiling water | 22% | 9% |
| Uster CV | 1.3 | 1.3 |
| Knot strength | excellent | fairly good |
| No. of knots/m | 34 | 20 |

(*) according to the known technique, process c. The three beams were placed on warp loom operating at 2000 picks/min. The fabric obtained was dyed in the laboratory. The dye used was disperse blue 056. On control, the dyed fabric exhibited an excellent dyeing evenness.

What I claim is:

1. A process for preparing drawn thermoplastic yarns comprising subjecting a partially oriented multifilament yarn to a tension sufficient to completely orient the yarn, and simultaneously contacting the taut yarn with a gaseous fluid jet at an angle, temperature and pressure such that the yarn is simultaneously drawn and interlaced at the point in is being drawn.

2. A process according to claim 1, wherein the temperature of the gaseous fluid jet is between about 75° and 200° C.

3. A process according to claim 1, wherein the angle at which the gaseous fluid jet contacts the yarn is about 90°.

4. A process according to claim 1, wherein the pressure of the gaseous fluid jet is about 4 bar.

5. A process according to claim 1, wherein the gaseous fluid comprises steam.

6. A process according to claim 1, wherein the drawn and interlaced yarn is wound on cops or bobbins.

7. A process for producing drawn thermoplastic yarns comprising subjecting a partially oriented multifilament yarn to a tension sufficient to form a drawing neck, and simultaneously contacting the yarn at the drawing neck with a gaseous fluid jet at an angle, temperature and pressure such that the yarn is simultaneously drawn and interlaced.

8. A process according to claim 7, wherein the temperature of the gaseous fluid jet is between about 75° and 200° C.

9. A process according to claim 7, wherein the angle at which the gaseous fluid jet contacts the yarn is about 90°.

10. A process according to claim 7, wherein the pressure of the gaseous fluid jet is about 4 bar.

11. An apparatus for simultaneously drawing and interlacing thermoplastic yarns at the same point, comprising at least one tubular chamber for drawing a partially oriented yarn, and a nozzle for injecting a jet of gaseous fluid into the tubular chamber positioned so that the jet of gaseous fluid is perpendicular to the direction of the yarn, said jet of gaseous fluid being at a temperature and pressure suitable for drawing and interlacing the yarn at the same point.

* * * * *